United States Patent [19]

Werding

[11] Patent Number: 4,458,830

[45] Date of Patent: Jul. 10, 1984

[54] APPLIANCE FOR DISCHARGING A NON-COMPRESSIBLE LIQUID, CREAMY OR PASTY PRODUCT UNDER PRESSURE

[76] Inventor: Winfried J. Werding, General Guisan 77, 1009 Pully, Switzerland

[21] Appl. No.: 296,202

[22] Filed: Aug. 25, 1981

[30] Foreign Application Priority Data

May 20, 1981 [CH] Switzerland ..... 3227/81

[51] Int. Cl.[3] ..... B67D 5/42; B65D 37/00

[52] U.S. Cl. ..... 222/131; 222/212; 222/215; 222/280; 222/386.5; 239/323

[58] Field of Search ..... 222/129, 386.5, 212, 222/213, 280, 399, 402.12, 94, 95, 131, 211, 215, 214; 239/320, 323, 327

[56] References Cited

U.S. PATENT DOCUMENTS

| | | | |
|---|---|---|---|
| 3,602,397 | 8/1971 | Marano | 222/95 |
| 3,669,313 | 6/1972 | Marano et al. | 222/95 |
| 3,677,444 | 7/1972 | Merrill | 222/215 X |
| 3,791,557 | 2/1974 | Venus, Jr. | 222/386.5 X |
| 3,796,356 | 3/1974 | Venus, Jr. | 222/212 |
| 3,982,668 | 9/1976 | Riccio | 222/402.18 X |
| 4,113,147 | 9/1978 | Frazier et al. | 222/131 |
| 4,251,032 | 2/1981 | Werding | 222/386.5 X |

*Primary Examiner*—Robert B. Reeves
*Assistant Examiner*—Russell D. Stormer
*Attorney, Agent, or Firm*—Heinrich W. Herzfeld

[57] ABSTRACT

A container of rigid material comprises an appliance which employs the contractional force of an expanded rubber hose and expanded product container for the discharge of a medium stored therein. A hollow body of elastic material located in the axis of the product container is provided with a valve at one end through which it is inflated. The shape of the inner walls of the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

3 Claims, 7 Drawing Figures

Figure 1:
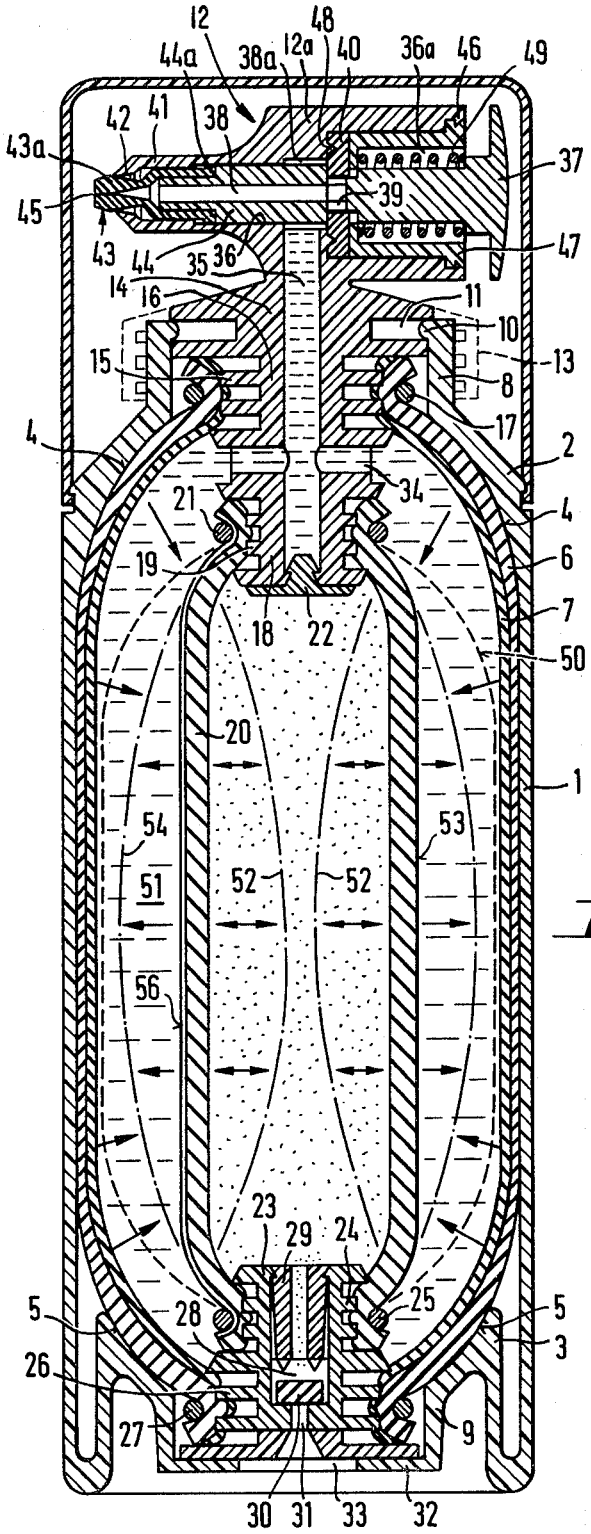

114
115
118
109
116
117
119
102
113
108
110
89
112
103
111
104
96
8
94
61
95
101
98
77
6
7
4
90
100
91
90
99
97
93
92
1
106
107
78
51
105
79
80
81
20
120
121
88
87
87
122
85
84
82
5
83
9
86
33

APPLIANCE FOR DISCHARGING A NON-COMPRESSIBLE LIQUID, CREAMY OR PASTY PRODUCT UNDER PRESSURE

BACKGROUND OF THE INVENTION

The present invention relates to a container comprising a squeezing pressure source, which acts upon creamy or liquid media, a discharge valve element for these media, as well as an appliance, which is able to keep the loss of squeezing pressure inevitably caused by stress and storage aging as low as possible and which allows to empty the container entirely except for the valve ducts.

Several patents, e.g. the U.S. Pat. No. 566,282, the U.S. Pat. No. 821,875, the U.S. Pat. No. 2,738,227, the U.S. Pat. No. 3,672,543 and the U.S. Pat. No. 3,796,356 describe spraying appliances relating to different embodiments in which macromolecular materials of the caoutchouc type are used as a pressure source. Non of these patents does in any way whatsoever mention a means to influence an inevitable loss of pressure due to the permanent loss of elasticity in the caoutchouc used.

The applicant of the Swiss Pat. No. 618 355 is the first who describes therein a rigid inner core, which is enveloped by a rubber hose serving as pressure source and having an inner diameter that is by preferably 75 percent larger than the inner diameter of the unstressed rubber hose, whereby a permanent extension of the inner diameter of the hose caused by stress and aging is avoided which would lead to a product loss through a loss of stress.

This solution proposed by the applicant represents a substantial progress as far as the use of the contractional force of an expanded rubber hose is concerned, but it can in no way influence the inevitable loss of contractional force caused by permanent stress and aging of the rubber used.

Examinations having been carried out for more than five years on the behavior of a radially-axially expanded rubber hose have shown that in addition to a permanent expansion a loss of contractional force is observed, which increases with the square proportionally to the percentage of expansion.

If such a rubber hose as described in the Swiss Pat. No. 618 355 by the applicant is used for gas-free spraying cans the loss of contractional force limits the use of such spraying cans to products only where the particle size of the sprayed product and the discharge rate per second is not important, as well as to products that do not have to be sprayed at all like oils, creams, etc.; in the latter case, however, their viscosity has to be so small that they can be discharged despite the loss of contractional force of the rubber hose, which serves as squeezing pressure source.

It is possible to decrease the loss of contractional force in limiting the expansion percentage of 450, as described in the Swiss Pat. No. 618,355, to 225 percent and in admixing preferably $CO_2$ or other inert gases to the product, as suggested by the applicant in the European Patent Application No. 80901498.8.

In this proposed solution the contraction pressure of the rubber hose prevents the escape of $CO_2$ from the product solution on the filling day. But as soon as the contraction pressure drops below the pressure level at which $CO_2$ escapes from the product solution, a $CO_2$-gas bubble is formed, the pressure of which acts on the product surface. Since the rubber hose contracts during discharge, i.e. the residual volume between the gas bubble and the product level remains equal, the $CO_2$-pressure acting on the product surface remains equal, too. However, this solution requires that such a spraying can has always to be used in a vertical position, otherwise $CO_2$ will escape which then leads to a pressure loss. Moreover this system is very susceptible to temperature. At temperatures over 30° C. such a big $CO_2$-gas bubble may form as to cause the bursting of the rubber hose. On the other hand temperatures below 10° C. may hamper the escape of $CO_2$ from the product so that the compensation of the contraction loss in the rubber hose aimed at is not achieved. Furthermore shaking may cause the dissolution of $CO_2$ from the product to such an extent that the large $CO_2$-gas bubble formed this way may cause the bursting of the system.

OBJECTS AND SUMMARY OF THE INVENTION

It is the object of the present invention to solve the aforementioned problems and to counteract the natural loss of contractional force in an expanded rubber hose so that this loss remains as small as possible. This task is solved by means of a container with a shoulder and a base part, comprising a core, a squeezing pressure source of macromolecular material of the caoutchouc type, a flexible product container mounted in the interior of the squeezing pressure source, a valve with a product discharge element—the product container and the squeezing pressure source may be hose-shaped and affixed to rigid valve-containing members at their two open ends—, wherein a core is designed as an inflatable hollow body of macromolecular material of the caoutchouc type being in the axis of the product container, the modulus of elasticity and the wall thickness of the hollow body and of the squeezing pressure source, including the product container, are in a predetermined ratio and the hollow body is provided with a valve at least at one end, on the one hand the inner wall of the container radially limits the expansion of the squeezing pressure source, including the product container, as well as the hollow body, on the other hand the inner walls of the shoulder part and the base part of the container are of at least approximately ovoid shapes, which are situated at the level of the axial, diagonal-radial expansion areas of the squeezing pressure source, including the product container, the shoulder part ends in a first cylindrical part and the base part ends in a second cylindrical part, the diameters of which are so large that the ends of an assembled appliance can be inserted there and means are provided to prevent a not predetermined axial elongation of the appliance, the inner diameter of the container is in a fixed ratio to the outer diameter of the squeezing pressure source in unstressed condition, and the wall thickness of the container is chosen as to resist the radial and axial pressures of the squeezing pressure source, of the product container and of the hollow body.

The present invention is based upon a strictly mechanical system, in which temperature fluctuations have no substantial influence on its functioning.

Figure 3:
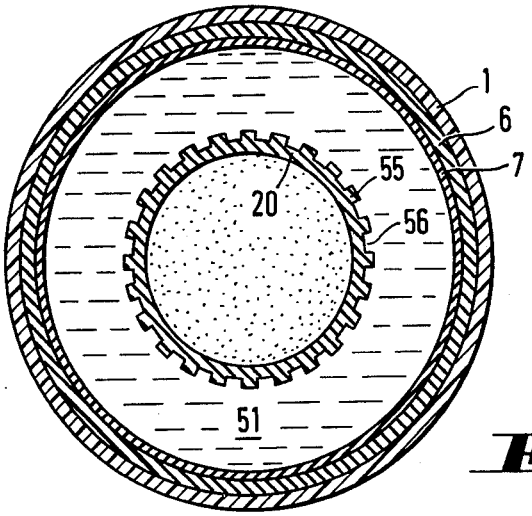
Figure 4:
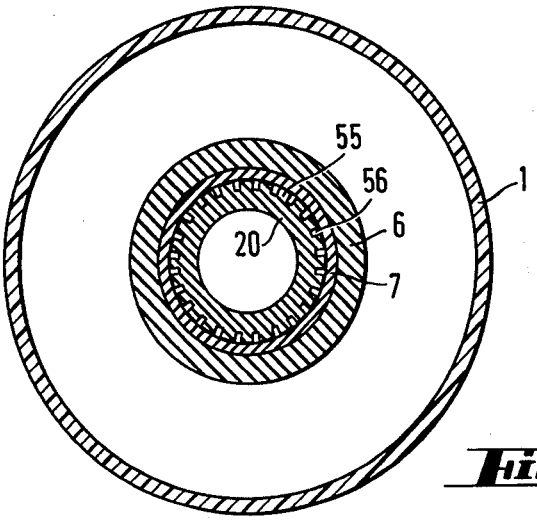
Figure 6:
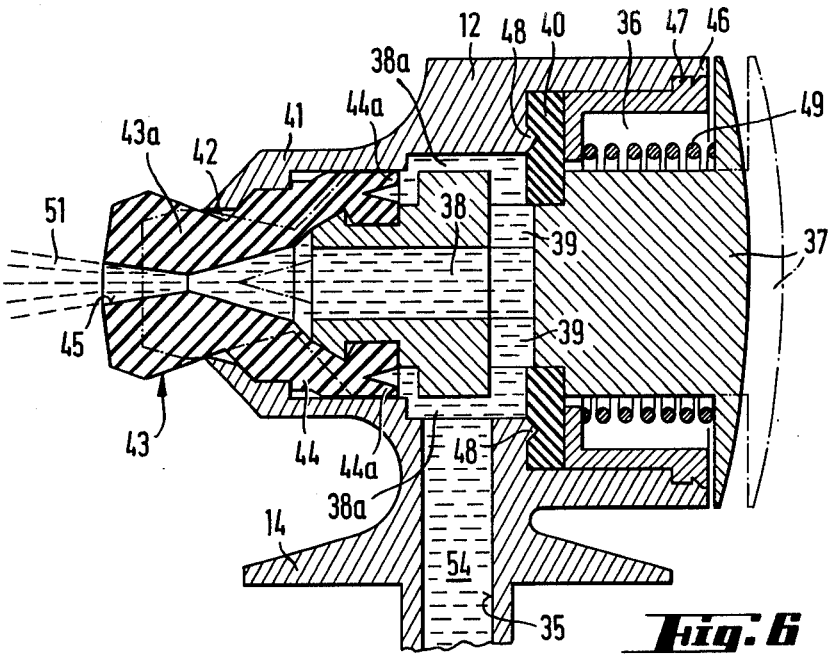
Figure 7:
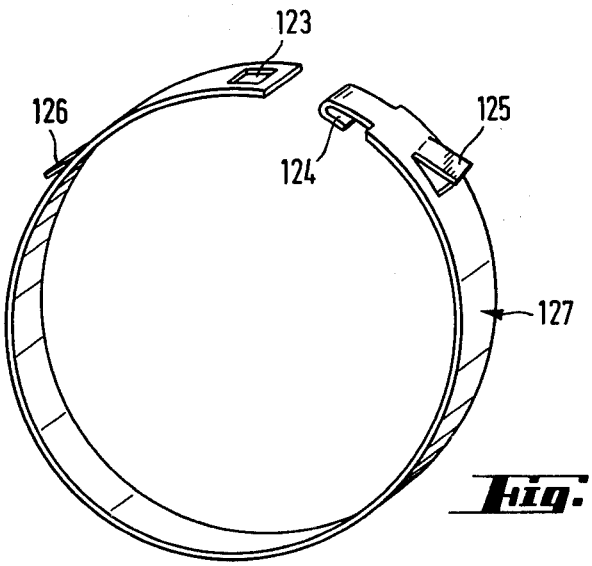

Further details of the invention are described and illustrated in the following specification of preferred embodiments. In the drawing FIG. 1 shows a view of a section through the invention with a discharge element closing at the front to be used for creams, oils, sirups or pastes, FIG. 2 shows a view of a section through the invention with a spray nozzle and an appropriate valve, FIG. 3 shows a top view of a section through a filled container according to the invention with appliance, FIG. 4 shows a top view of a section through an empty container according to the invention with appliance, FIG. 5 shows a view of a section through another preferred embodiment of the invention containing an air suction mixing valve, FIG. 6 shows a view of a section through a discharge element closing at the front in opened condition, FIG. 7 shows a perspective view of a particularly advantageous hose clamp.

FIG. 1 is a view of a section through a container 1 according to the invention comprising an appliance. The external container 1 has a shoulder part 2 and a base part 3, which are provided with the ovoid seats 4 and 5 respectively, the shapes of which are adapted to those the expanded rubber hose 6 and a flexible, expandable product container 7 stored therein assume by themselves when they are filled and/or expanded. The shoulder part 2 merges into the cylindrical collar 8 and the base part 3 merges into the cylindrical seat 9, serving to receive the non-expandable ends of the rubber hose 6 and the product container 7. In unfilled condition the assembled appliance is shorter than the distance between the front faces of the collar 8 and the seat 9. This allows the appliance to extend axially during filling, without exerting an excessively high thrust on the front faces of the collar 8 and the seat 9, whereby their walls may be designed as thin as possible. Moreover the rubber hose 6 can thereby be kept in a stressed condition even after complete emptying of the product container 7, because the inflatable hollow body 20 described in the following does not shrink again if once inflated. Since the stress of the rubber hose 6 is maintained until the product container 7 is emptied completely the contraction pressure acting on the filled-in product remains high enough to guarantee an atomization of the filled-in product. In addition the inner diameter of the rubber hose 6 may thus be kept large enough as to be fixed easily around the unfilled product container 7, which makes manual assembling possible, or, in the case of automatic assembling, allows for higher production, which in turn influences the price favorably. Similarly, a shorter appliance in unfilled condition can be manufactured at a lower price, since less of expensive rubber material is required. The collar 8 of the container 1 is provided with the snap-in annular rib 10, which engages an appropriate groove 11 of the valve housing 12. A screw cap may also be provided as shown by broken lines 13. The valve housing 12 is provided with the tube part 14, which has a seat 16 provided with several annular ribs 15; the product container 7 and the rubber hose 6 are fastened sealingly to seat 16 by means of the hose clamp 17. At lower the end of the tube part 14 there is the neck part 18 provided with several annular ribs 19, which is fixed in the upper open end of the inflatable hollow core body 20 by means of the hose clamp 21. The bottom opening of the duct 35 in the tube part 14 is closed sealingly with the stopper 22. The lower open end of the hollow core body 20 has inserted therein the tube part 23, which is provided with annular ribs 24 to which the hollow core body 20 is fixed sealingly by the hose clamp 25, whereas the product container 7 and the rubber hose 6 are fixed to the annular ribs 26 by the hose clamp 27. In the tube part 23 there is a non-return valve 28 consisting of a notched tube plug 29 and the gasket 30, which closes the opening 31 sealingly towards its outer side as soon as the hollow core body 20 is under pressure. The tube part 23 with the product container 7 and the rubber hose 6 both fastened thereon is lodged in the cylindrical seat 9, the bottom 32 of which limits the axial elongation of the appliance due to the expansion of the rubber hose 6 caused by inflating the hollow core body 20 and filling the product container 7. The bottom 32 is provided with the hole 33 through which the hollow core body 20 can be inflated. The valve housing 12 has a tubular part 12*a* extending transverse to the longitudinal container axis and a longitudinal drill hole 36 as a transverse duct in which the duct 35 of the tube part 14 ends at which duct 35 is connected with the product container 7 via the transverse ducts 34. At one end, this drill hole or duct 36 communicates with a cavity 36*a* opening out of one end of the tubular part 12*a*, while the drill hole 36 ends at its opposite end in a round opening 42 . In the cavity 36*a* and drill hole 36 there is lodged, serving as the valve body, a piston 37 provided with an axial duct 38 and with transverse ducts 39 which communicate with the axial duct 35 when the valve is open, but which can be closed by means of the gasket 40 lodged in a neck region of the piston 37. The end 41 of the valve housing 12 is provided with a conical round opening 42, which can be closed by the conical plug 43 of elastic material. The plug 43 is fastened to piston 37 at its tubulure part 44, the end of which plug 43 is provided with an annular lip 43*a*, which closes the longitudinal drill hole 36 radially at the end 41 of the valve housing 12. The plug 43 is provided with a slot 45, which remains closed because it is squeezed in the conical round opening 42, and thus also closes the duct 38. In the cavity 36 which opens out of a transverse tubular portion 46 of the valve housing 12 there is inserted the sleeve 47, which presses the gasket 40 firmly against the annular rib 48 causing the gasket to seal the inner end of the cavity 36 at this level, while an inner flange of sleeve 47 serves at the same time as seat for the compression spring 49, which urges the piston 37 towards the open end of the tubular portion 46 and thus pulls firmly the cone 43*a* of the plug 43 into the inversely conical round opening 42 so that the slot 45 remains squeezed together as mentioned before. When unfilled the hollow core body 20, the product container 7 and the rubber hose 6 are pressed firmly against each other and are in a practically parallel position to the longitudinal axis of the container, as shown in FIG. 4, the cylindrical parts 8 and 9 axially holding the whole unit. The filling process of the invention may for instance be as follows: The hollow core body 20 is filled, e.g., with air, via the non-return valve 28 until the hollow body maximally assumes the shape shown by line 50. Afterwards the product container 7 is filled via the valve housing 12 and the tube part 14; the product container 7 expanding itself also expands the rubber hose 6 until both are limited in their expansion, to be more precise, radially by the container 1, diagonally and radially by its shoulder part 4 and its base part 5, and axially by the front faces of the collar 8 and the seat 9, and then the filling process is continued until the predetermined filling volume is reached. Since the non-compressible medium 51 cannot extend the product container 7 and the rubber hose 6 beyond the limitations set by the container 1, the filling pressure is transmitted to the hollow core biody 20, giving it depending on the filling volume the shape shown by line 52, which, due to the consequent reduction of the inner volume of the inflated hollow core body 20, leads to a substantial pressure increase in its interior. This pressure has the tendency to inflate the hollow core body 20 but is prevented in doing so by the non-compressibility of the medium 51 and the rigid walls of the container 1. As long as there is no change in the volume occupied by the product in the product container 7, as for instance during storage, the pressure transmitted from the product to a measuring instrument remains practically constant. It is only after the commencement of the emptying process that the pressure loss due to stress and storage aging becomes effective, but is counteracted according to the invention as described in the following. If, in order to use the medium 51, e.g. a toothpaste, the piston 37 is depressed, the inlets of the transverse ducts 39 are brought in alignment with the duct 35, which ends in the annular duct 38*a*. At the same time the plug 43 is ejected out of the opening 42 and the medium 51 upon which the contraction pressure of the product container 7 and the rubber hose 6 is exerted on the one hand, and the expansion pressure of the hollow core body 20 on the other hand, opens the slot 45 of the plug 43 thanks to this conjugated discharge pressure as illustrated by FIG. 6. If the pressure upon the piston 37 ceases it is pushed back by the compression spring 49 into its initial position and the transverse duct 39 returns back into the gasket 40 which closes it. Simultaneously the plug 43 is pulled into the opening 42, the diameter of which is smaller than the outer diameter of the plug 43, and being of elastic material it is thus squeezed together which in turn closes the slot 45, so that the medium 51 present in the duct 38 does not remain in contact with the oxygen of the air and thus cannot dry up. With the proceeding emptying of the product container 7 the hollow core body 20 assumes a continuously larger volume, as shown for instance by the lines 53 and 54, due to the increased pressure in its interior, and eventually reassumes the shape of line 50. Because the hollow core body 20 compressed by the product pressure is practically not exposed to any stress during storage, no stress aging occurs in return. It is subjected only to the normal storage aging, which in this case is an advantage, because the more the rubber of the hollow core body 20 loses in resistance through aging against an expansionary force, the easier it may be expanded by the pressure prevailing in its interior and the easier its expansionary pressure compensates the contractional pressure loss of the product container 7 and the rubber hose 6 caused by stress and aging. Because the hollow core body 20 is provided with longitudinal ribs 55 at the side facing the product container 7, as shown in FIGS. 3 and 4, the medium 51 can flow along the ducts 56 to the transverse ducts 34 and leave the product container 7 as described above, so that the latter is almost entirely emptied. Only the ducts 56, 34, 35, 38, and 39 remain filled. These, however, have such a small total volume that the product amount remaining in them is negligible.

Figure 2:
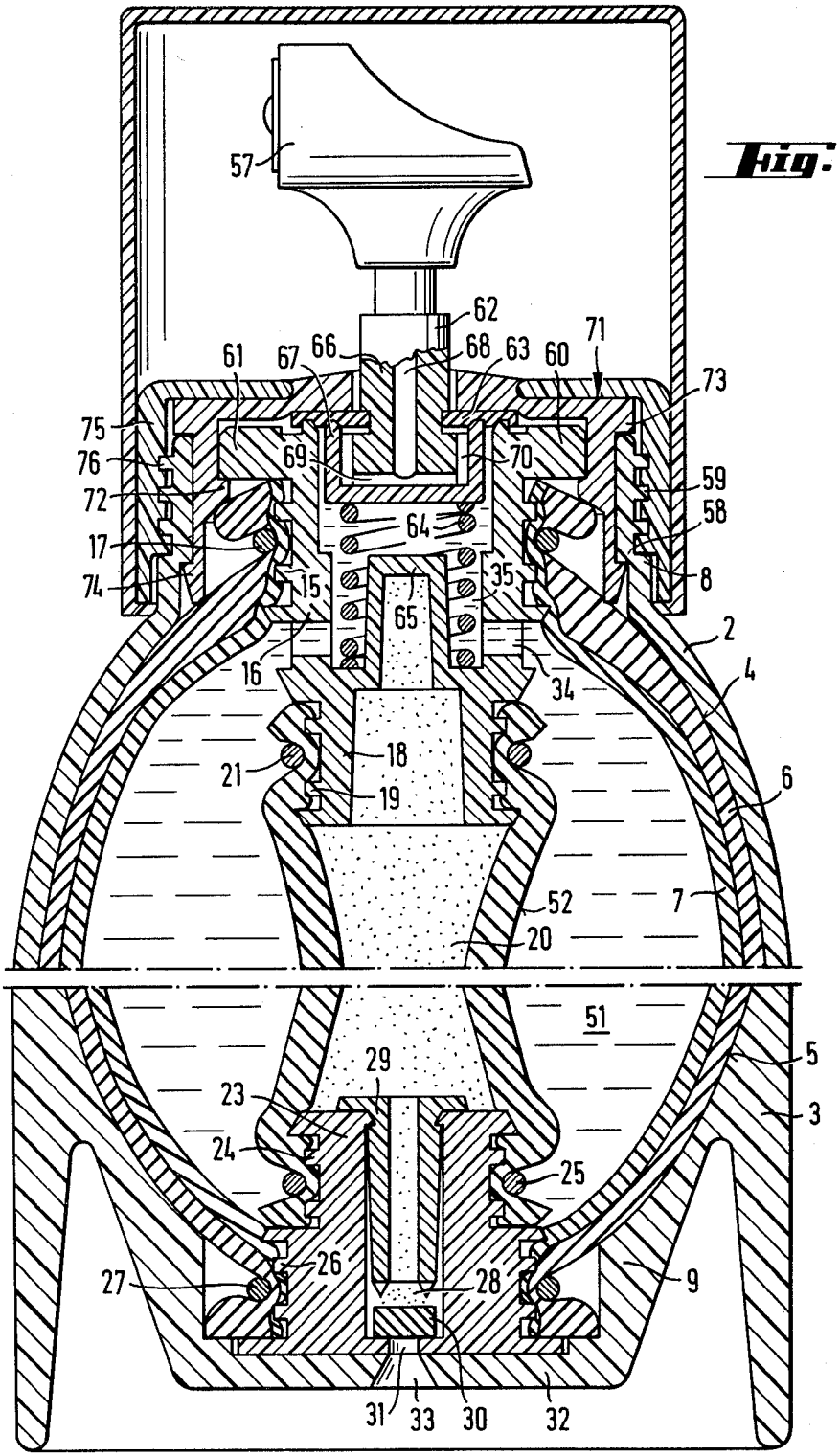

FIG. 2 shows another preferred embodiment of the invention, in which the medium 51, e.g. hair lacquer is atomized by means of a known spray nozzle 57 during discharge. The container 1 is blown of synthetic material (e.g. polyethylene), the collar 58 is provided with a male thread 59. The valve unit 60 consists of the valve housing 61, the piston 62, the gasket 63, and the compression spring 64. The valve housing 61 has a seat part 16 with annular ribs 15, to which the product container 7 and the rubber hose 6 are fastened sealingly by means of the hose clamp 17. At the lower end of the valve housing 61 there is the seat 18 with annular ribs 19, to which the inflatable hollow core body 20 is fixed by means of the hose clamp 21. The hollow core body 20 and the product container 7 are of the same elastomer, preferably of butyl rubber and most preferably of bromobutyl rubber, whereas the rubber hose 6 is preferably of natural rubber. The housing chamber 35 containing the compression spring 64 is connected with the product container 7 via the transverse ducts 34. In the axis of the housing chamber 35 there is the piston stop 65. The piston 62, constituting the valve body, consists of two parts, the tubulure part 66 and the cup 67, which receives the tubulure part 66, the duct 68 of which ends in a cross groove 69, which is connected with vertical side grooves forming together with the inner wall of the cup 67 four passages 70. The compression spring 64 presses the piston unit 62 firmly against the gasket 63, whereby the passages 70, the adjacent cross groove 69 and the duct 68 are sealingly closed off, the medium 51 being under squeezing pressure. The gasket 63 is sealingly pressed against an upper annular head on the valve housing 61 by means of an annular radially inwardly projecting flange of the sleeve 71, the spring catch 72 guaranteeing a rigid anchorage between valve housing 61 and sleeve 71. The unfilled assembly is inserted into the external container 1, thus the tube part 23 is placed at the inlet of the cylindrical seat 9 and the flange 72 of the sleeve 71 rests upon the collar 58 of the external container 1, so that the spring catch 74 snaps into place and thus guarantees an anchorage of the assembly in container 1. Because the appliance extends axially when being filled and thus might burst the anchorage of the spring catch 74, a cap nut 75 is provided, the female thread 76 of which is screwed on the male thread 59 of the collar 58 to guarantee a secure anchorage. FIG. 2 shows an appliance in filled condition during storage and moreover shows that the hollow core body 20 assumes the approximate shape indicated by 52 under the radial pressure exerted upon it by the medium 51, so that there is a large pressure reserve in its interior as described above in FIG. 1. If the piston 62 is moved downwards by the spray nozzle 57, the compression spring 64 is compressed and the upper edge of the cup 67 moves away from the gasket 63, whereby the passages 70 are opened so that the medium 51 being under contraction and expansion pressure flows into the duct 68 via the cross groove 69 and is then atomized by the spray nozzle 57 until the pressure thereon is released and the compression spring 64 again presses the piston 62 firmly against the gasket 63 and thus closes the entire valve unit 60, and thereby also the appliance.

Figure 5:
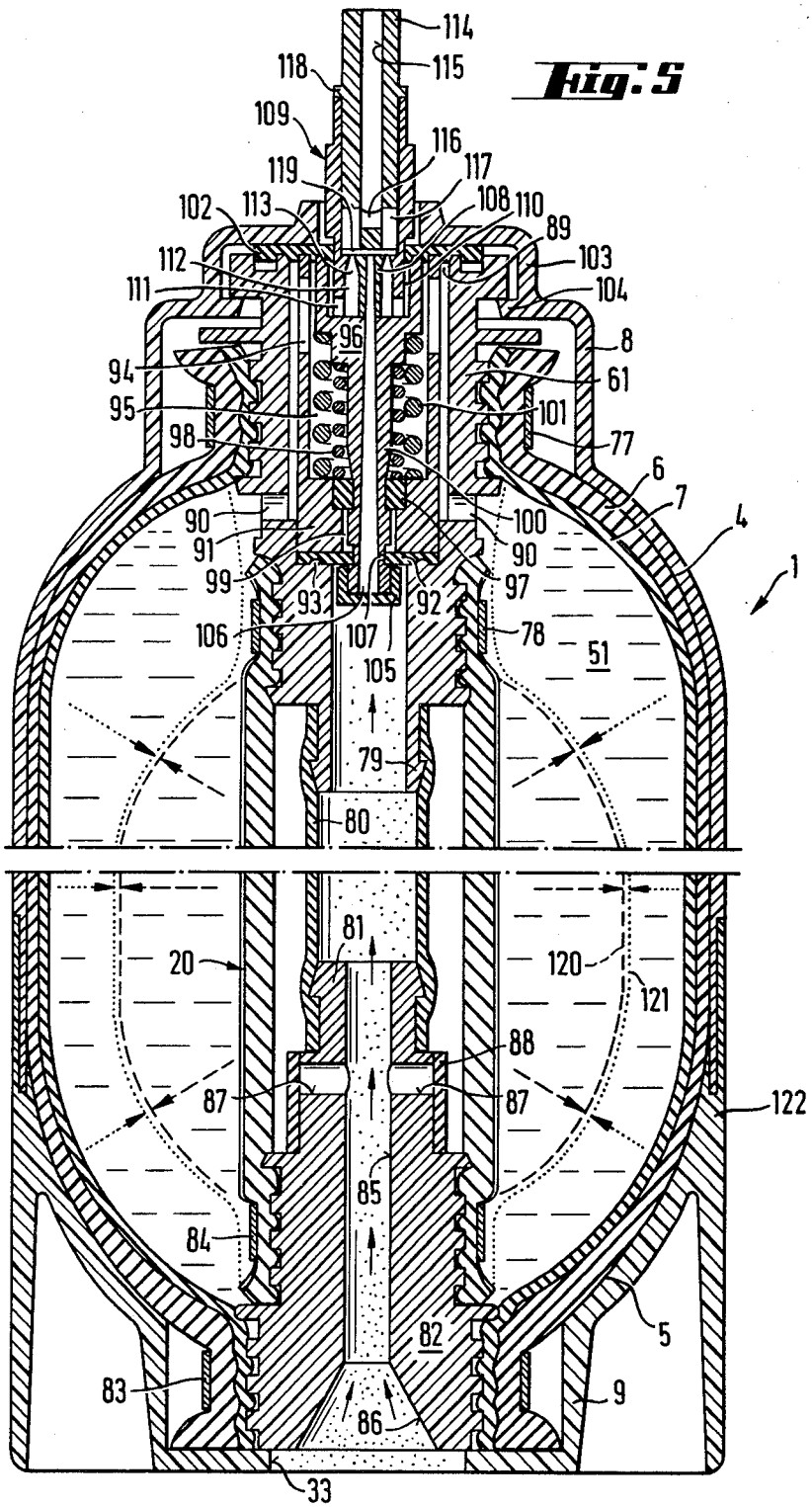

FIG. 5 is a view of a section through another preferred embodiment of the invention.

For economic reasons the wall thickness of the rubber hose 6 serving as the squeezing pressure source has to be kept as thin as possible so that the squeezing pressure cannot be increased at random by means of thicker walls. It may, however, occur that a product requires a very fine atomization, which could be achieved easily by a higher squeezing pressure, but which is not available due to the aforementioned reasons of too high costs. Nevertheless it has been found that air bubbles if admixed to the product to be atomized burst when escaping from a spray nozzle and thereby disperse the already atomized droplets, i.e. reduce their size once again. The appliance shown in FIG. 5 is provided with a valve that sucks in air during opening and admixes it in the form of bubbles to the product 51 being in course of disharge. The rubber hose 6 and the product container 7 are fixed to the valve housing 61 by means of the hose clamp 77, and the hollow core body 20 is fixed to the valve housing 61 by means of the hose clamp 78. The valve housing 61 is provided with a nipple 81 of the non-return valve body 82; the total length of the tubular piece 80 is chosen as to become stretched when the appliance in filled condition reaches its predetermined maximum length. The rubber hose 6 and the product container 7 are fixed to the valve body 82 by means of the hose clamp 83, and the hollow core housing 20 is fixed to the valve housing 82 by means of the hose clamp 84. The valve housing 82 is provided with the duct 85 with the conical inlet 86 and the transverse duct 87 which is covered by the rubber hose 88 in such a way that air may enter into the hollow core body 20 through the transverse duct 87 but cannot escape again and thus acts as a non-return valve. The valve housing 61 is thus in contact with the outside air via the tubular piece 80, the duct 85 and the conical inlet 86. The valve housing 61 comprises a cavity 89 whose bottom is constituted by an annular shoulder 93 in the housing 61. This cavity 89 is connected with the product container 7 by the ducts 90 so that the product 51 being under squeezing pressure can enter the cavity 89. This cavity 89 houses an inner valve housing part containing a valve chamber 95, and serving as a squeezing sleeve 91 which presses a gasket 92 against the annular shoulder 93 of the valve housing 61. The upper part of the squeezing sleeve 91 has longitudinal slots 94 through which the product 51 enters the valve chamber 95. In the latter a valve body shaped as a tubular piston 96 is located which supports the gasket 97 which is urged, by a compression spring 98, to close sealingly the annular space 99 in the bottom of squeezing sleeve 91. A conical downwardly narrowing region 100 of the tubular piston 96 also having a sealing effect. The squeezing sleeve 91 contains the compression spring 101 which supports itself against the tubular piston 96. The gasket 102 rests upon the sharp edges of the valve body 61, of the squeezing sleeve 91 and of the tubular piston 96 and is firmly pressed with the sleeve 103 of the container 1 against the aforementioned sharp edges by means of the spring catch 104 in a way that not only the valve body 61, the squeezing sleeve 91 and the tubular piston 96 are sealed towards the top by penetrating into the gasket 102, but also the squeezing sleeve 91 is pressed firmly against the gasket 92 which rest on the annular shoulder 93 and seals off the cavity 89 against the interior of the tubular piece 80 and thus against the outside air. At the lower end of the tubular piston 96 there is the locking sleeve 105, which closes the duct 106 towards the lower end. It is provided with a side duct 107 which can be closed by the gasket 92. The duct 106 of the tubular piston 96 tapers towards the top and ends in the tube part 108, which protrudes axially into the upper piston 109. The latter is provided with the side grooves 110 and the bottom grooves 111 that are connected with the annular duct 112, having the ring narrowing 113, the narrowest part of which is in the same height as the mouth of the duct 106. Within the annular duct 112 there is the pin 114 with the longitudinal duct 115 and the transverse duct 116; the longitudinal duct 115 is axially closed towards the lower end and the transverse duct 116 ends into two side grooves 117, which reach to the closed end of the pin 114 and thus are in alignment with the ring narrowing 113. The length of the pin 114 is designed so that its closed end is very near to the mouth of the duct 106 in a predetermined distance and the annular rib 118 prevents that the closed end of the pin 114 obstructs this mouth. Thus a transverse duct 119 is formed, situated vertically to the annular duct 112 and its ring narrowing 113, whereby it functions in the way a VENTURI-system does. As described above the product 51 flows through the ducts 90 and the longitudinal cuts 94 of the squeezing sleeve 91 into the cavity 89 up to gasket 102. If a pressure is exerted on the pin 114 from the top downwards, the tubular piston 96 strains the compression springs 98 and 101 and moves away from the gasket 102, and at the same time the side duct 107 leaves the gasket 92, thus bringing the duct 106 into contact with the outside air through the tubular 80. The product 51 being under squeezing pressure leaves the hollow space 89 through the side grooves 110 and the bottom grooves 111 and enters the annular duct 112 and its ring narrowing 113 where it is accelerated and loses some of its pressure which is, however, restored again in the side ducts 117 of the pin 114. Because the product 51 passing the transverse duct 119 has a higher pressure than the outside air and the diameter of the transverse duct 119 is smaller than the diameter of the ring narrowing 113 and is in vertical position to the latter, the product 51 sucks in outside air in the course of being discharged thanks to the described VENTURI-effect and the sucked-in air forms tiny bubbles in the product 51 that expand as soon as they get into contact with the outside air when leaving the spray nozzle and further reduce the size of the product droplets having already been mechanically atomized as described before. If the vertical pressure on the tube (pin) 114 is released, the springs 98 and 101 press the main piston 96 upwards, whereby its sharp edges penetrate again into the gasket 102 and the side duct 107 is closed again by the gasket 92 and thus seals the appliance again. The broken line 120 shows the shape the hollow core body 20 assumes approximately and the dotted line 121 shows the shape the rubber hose 6 and the product container 7 assume approximately after the complete product discharge. The container 1 is closed at the bottom by a base part 127; the fixture is achieved by welding, glueing, screwing, snapping-in, etc. depending on the material used.

FIG. 7 shows a hose clamp which serves for the sealing fixture of the rubber hose 6, the product container 7, and the hollow core body 20 onto the described valve bodies and their seats provided therefor. Since the product 51 is in permanent contact with the hose clamps that fix the hollow body 20 as well as with the compression springs of the different valve elements, the compression springs and the hose clamps have to be of the same material to avoid any electrolysis and corrosion. The material best suited for this purpose is stainless steel. The hose clamp consists of a strip provided with an opening 123 at the one end and a hook 124 at the other end to be hooked in the opening 123. In a short distance from the opening 123 and the hook 124 there are the barbs 125 and 126. They serve as counter bearing of a clamp-like tool, which brings together the ends of the hose clamp so that the hook 124 is placed in the opening 123 and hooks in there when the tool is opened. Because the hose clamp rests upon elastic material, the latter presses together the hook 124 which prevents the opening of the hose clamp.

Of course the present invention is not limited to the listed embodiments. It could also take the form of a double-walled car-tire, the inner wall being of higher elasticity than the armored outer wall. The hollow space between the inner and the outer tire is provided with a valve and the double-walled tire is mounted to the rim like a tubeless tire. If the inner tire is inflated first it expands until it touches the inner wall of the outer tire. If then the hollow space between the inner and the outer tire is inflated the inner tire, being more elastic than the outer tire, is compressed again. In case the outer tire becomes leaky the inner tire expands again and avoids the undesired wear and tear of the outer tire for a certain time and it may also be used as a spare tire in case of an emergency in order to reach the next garage.

The invention could also be designed as a fual container for a propeller-driven plane to ensure a constant fuel distribution in extreme heights despite decreasing air pressure.

I claim:

1. An appliance for discharging a non-compressible liquid, creamy or pasty medium comprising (a) an external elongated, rigid-walled container, having an open top end and an open base end, and a central axis extending longitudinally therethrough, (b) a contracting element having a top end and a bottom end, of caoutchouc-type macromolecular material, said element being located in the interior of said external container, (c) a flexible, expandable product container mounted in the interior of said contracting element and having an upper end and a lower end; said contracting element being adapted for exerting squeezing pressure on said product container, (d) an elongated, hollow core body which is inflatable radially with regard to said longitudinal container axis, lodged in the interior of said flexible product container about said longitudinal axis of said external container, having a top end and a bottom end, (e) first valve means mounted in said open top end of said external container and closing the same off, said top ends of said contracting element, said upper end of said product container, and said top end of said core body being sealingly attached to said first valve means, said first valve means comprising a valve-controlled passageway therethrough for flow of said non-compressible medium between the interior space in said product container surrounding said core body, and the outside, whereby said non-compressible medium can be filled into, and discharged from, said product container, (f) second valve means on the inside of said open base end, said bottom end of said core body, said lower end of said product container and said bottom end of said contracting element being sealingly attached to said second valve means, whereby, while said contracting element, said product container and said core body are fully elongated downwardly along said longitudinal axis, said valve means will come to rest against said base end and close off the interior of said external rigid-walled container outside said contracting element, said second valve means comprising a valve controlled passageway therethrough for air into said core body from the outside, thereby inflating said core body to a determined maximum expansion, said core body, when in inflated condition being compressible, with pressure increase in the interior of said core body, by non-compressible medium filled into said product container, and being squeezed by said contracting element, (g) said external container having a sidewall strong enough to limit the radial expansion of said product container and said contracting element enveloping said product container to the internal width of said external container, and (h) said contracting element being prestressed when having its ends mounted in said first and second valve means and when said core body is inflated to have substantially cylindrical configuration intermediate said top end and said bottom end thereof, whereby inflation of said core body compensates for loss of contractional force of said contracting element.

2. The appliance of claim 1, wherein said first valve means comprise (i) a valve housing having an axial tube part extending axially along said longitudinal container axis, a tubular part extending transverse to said axis, said tubular part having a cavity opening out of one end thereof, a discharge opening at the opposite end, and a transverse duct therethrough extending transversely to said axis and connecting said cavity and said discharge opening with one another, said axial tube part having a lower end, an axial duct opening at one end thereof out of said lower tube part end into said product container, said axial duct opening at its opposite end into said transverse duct, (ii) a valve body having a piston part, a tubulure part, a product channel in said tubulure part and having a channel axis transverse to said container axis and opening out of said discharge opening of said valve housing, said valve body being lodged in said valve housing with said piston part in said cavity, and with said tubulure part being lodged in said transverse duct of said transversely extending tubular part, of said valve housing, said valve body being displaceable relative to said valve housing along said channel axis, said valve body having communicating duct means extending from said product channel to outside of said tubulure part, and (iii) gasket means about said tubulure part of said valve body and obturating said communicating duct means, when said valve body is in valve closing position, and spring means biassing said valve body into closing position, while upon depressing said piston part against the bias of said spring means, said valve body is displaced to have said communicating duct means register with the upper end of said axial duct in said axial tube part of said valve housing, thereby establishing free communication between the interior of said product container and said discharge opening of said valve housing via said product channel of said valve body.

3. The appliance of claim 2, wherein said first valve means comprise a conical plug firmly mounted in said product channel at that end of said channel located in said discharge opening, said plug protruding partly from said discharge opening, said plug having a slot therein in communication with said product channel, said slot being closed when said valve body is in closing position with said plug moved more rearward into said product channel by the effect of said spring means, and said slot being open when said plug is advanced more forward out of said product channel, when said piston part is depressed.

* * * * *